US006716071B2

(12) United States Patent
Miyazaki

(10) Patent No.: US 6,716,071 B2
(45) Date of Patent: Apr. 6, 2004

(54) MOLDED ELECTRICAL CONNECTOR

(75) Inventor: Sho Miyazaki, Nagoya (JP)

(73) Assignees: Autonetworks Technologies, Ltd., Nagoya (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/266,676

(22) Filed: Oct. 9, 2002

(65) Prior Publication Data

US 2003/0171042 A1 Sep. 11, 2003

(30) Foreign Application Priority Data

Mar. 5, 2002 (JP) ..... 2002-058300

(51) Int. Cl.[7] ..... H01R 4/48
(52) U.S. Cl. ..... 439/859; 439/421
(58) Field of Search ..... 439/882, 421, 439/423, 424, 877, 859, 442

(56) References Cited

U.S. PATENT DOCUMENTS 849,028 A * 4/1907 Stevens ..... 439/868
2,685,076 A * 7/1954 Hoffman ..... 439/882
3,777,051 A * 12/1973 Ziegler et al. ..... 174/94 R
3,892,459 A * 7/1975 Dittmann et al. ..... 439/442
3,895,851 A * 7/1975 Bolton et al. ..... 439/387
4,486,063 A * 12/1984 Seifert et al. ..... 439/442
4,813,893 A * 3/1989 Sindlinger ..... 439/730
6,573,450 B2 * 6/2003 Saito et al. ..... 174/65 G
6,583,352 B2 * 6/2003 Fukushima et al. ..... 174/35 R

* cited by examiner

*Primary Examiner*—Hae Moon Hyeon
(74) *Attorney, Agent, or Firm*—Oliff & Berridge, PLC

(57) ABSTRACT

A terminal fixtures of a molded connector has a device connection part and a wire connection part connected with an electric wire. A circular outer covering is provided at a terminal end of the wire connection part and the electric wire. A circular outer covering is fit into a circular mounting hole of a case of an external device, and the device connection part is connected to a device body within the case by resin molding. Since the center of the connection part is aligned with the axial center of the electric wire and the axial center of the outer covering, the connection part passes through the center of the mounting holes.

5 Claims, 7 Drawing Sheets

MOLDED ELECTRICAL CONNECTOR

BACKGROUND OF THE INVENTION

The present invention relates to a molded connector in which a terminal fixture is covered by resin molding.

A possible technical approach to connect a connector of a wire harness to an inverter in an electric motor vehicle, is present. In the approach, a molded connector is manufactured such that a terminal fixture is connected to a terminal end of an electric wire, and the wire connection part of the terminal fixture and the terminal end of the wire are covered by resin molding. An outer covering of the molded connector is fit into a mounting hole of an inverter case. A device connection part protruded from the front end of the molded connector is firmly fixed to a terminal base within an inverter case.

A terminal fixture that is available for the structure is a terminal fixture having a universally usable shape, which is formed by bending a plate formed by pressing a piece in a predetermined shape. The terminal fixture is constructed such that the wire connection part is shaped like an open barrel, and a plate-like device connection part is extended with respect to the bottom wall of the wire connection part in an even level fashion. In a state that an electric wire is pressingly set to the wire connection part, the center of the electric wire is set off from the center of the device connection part. The resin outer covering is formed coaxial with the electric wire in order that a deformation of the housing owing to an inverted blister generated during the resin molding is uniformized by making the thickness of the housing uniform.

Therefore, when the device connection part is passed through the mounting hole so that the mounting hole is coaxial with the outer covering, the device connection part passes a position set off from the center of the mounting hole. Accordingly, in a case where the device connection part is wide or where the electric wire is thick and a quantity of eccentricity of the device connection part thereof is large, the inside diameter of the mounting hole must be increased. The result is that the outer covering diameter is large, and the molded connector is large in size as a whole.

SUMMARY OF THE INVENTION

Accordingly, an object of the present invention is to reduce the size of the molded connector.

According to a broad aspect of the invention, there is provided a molded connector to be mounted on a device in which a device body is accommodated in a case having a circular mounting hole, in which the molded connector includes a terminal fixture having a device connection part and a wire connection part connected to an electric wire, and a circular outer covering which is coaxial with the electric wire and is applied to the wire connection part and a terminal part of the electric wire, the outer covering is fit into the mounting hole, and the device connection part is connected to the device body, the improvement being characterized in that the center of the device connection part is aligned with the axial center of the electric wire.

In a preferred embodiment, the device connection part is shaped like a plate, and is shaped like such an open barrel that a pair of caulking pieces are raised from the right and left side edges of a bottom plate thereof. The caulking pieces are driven together to enclose the electric wire. A bottom plate of the wire connection part and the device connection part are coupled to each other by a stepped coupling part, so that those are vertically set off from each other, whereby the center of the device connection part is aligned with the axial center of the electric wire.

In another embodiment, reinforcing parts are respectively formed on the right and left side edges of the coupling part, the reinforcing parts being continuous to the front ends of the caulking pieces and the rear end of the device connection part.

[Aspects 1 and 2]

In the invention, the center of the device connection part is aligned with the axial center of the electric wire and the outer covering. Accordingly, the device connection part passes the center of the mounting hole. With this, the inside diameter of the mounting hole is made small, and will reduce the outside diameter of the outer covering, and the size of the molded connector.

[Aspect 3]

The reinforcing part is provided. Accordingly, the deformation of the coupling part is prevented without fail, so that the device connection part is held in a state that it is coaxial with the electric wire.

DETAILED DESCRIPTION OF THE PREFERRED EMBODIMENTS

<Embodiment 1>

Figure 1:
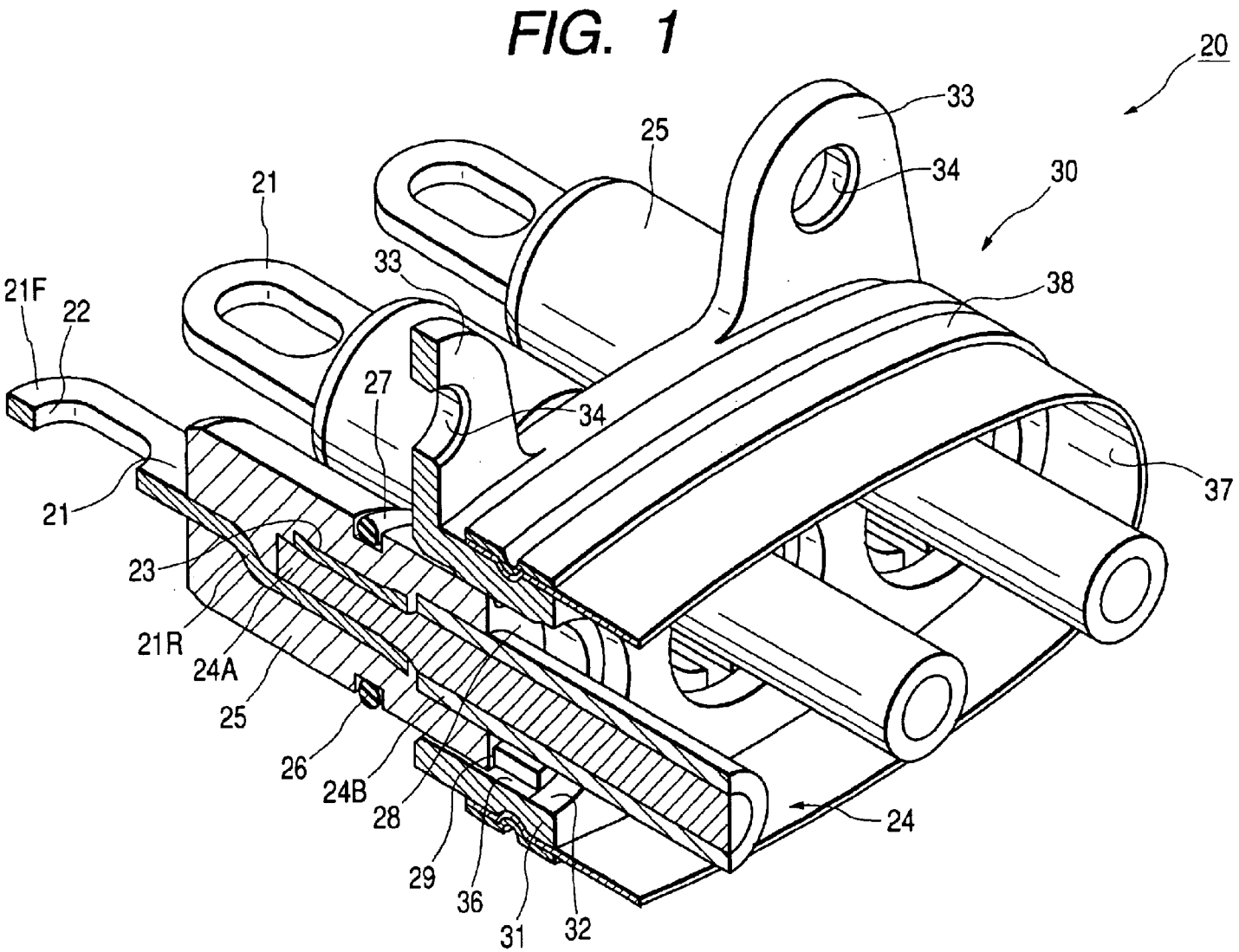
FIG. 1 is a perspective view, partly cut out, showing an embodiment 1 of the invention.
Figure 2:
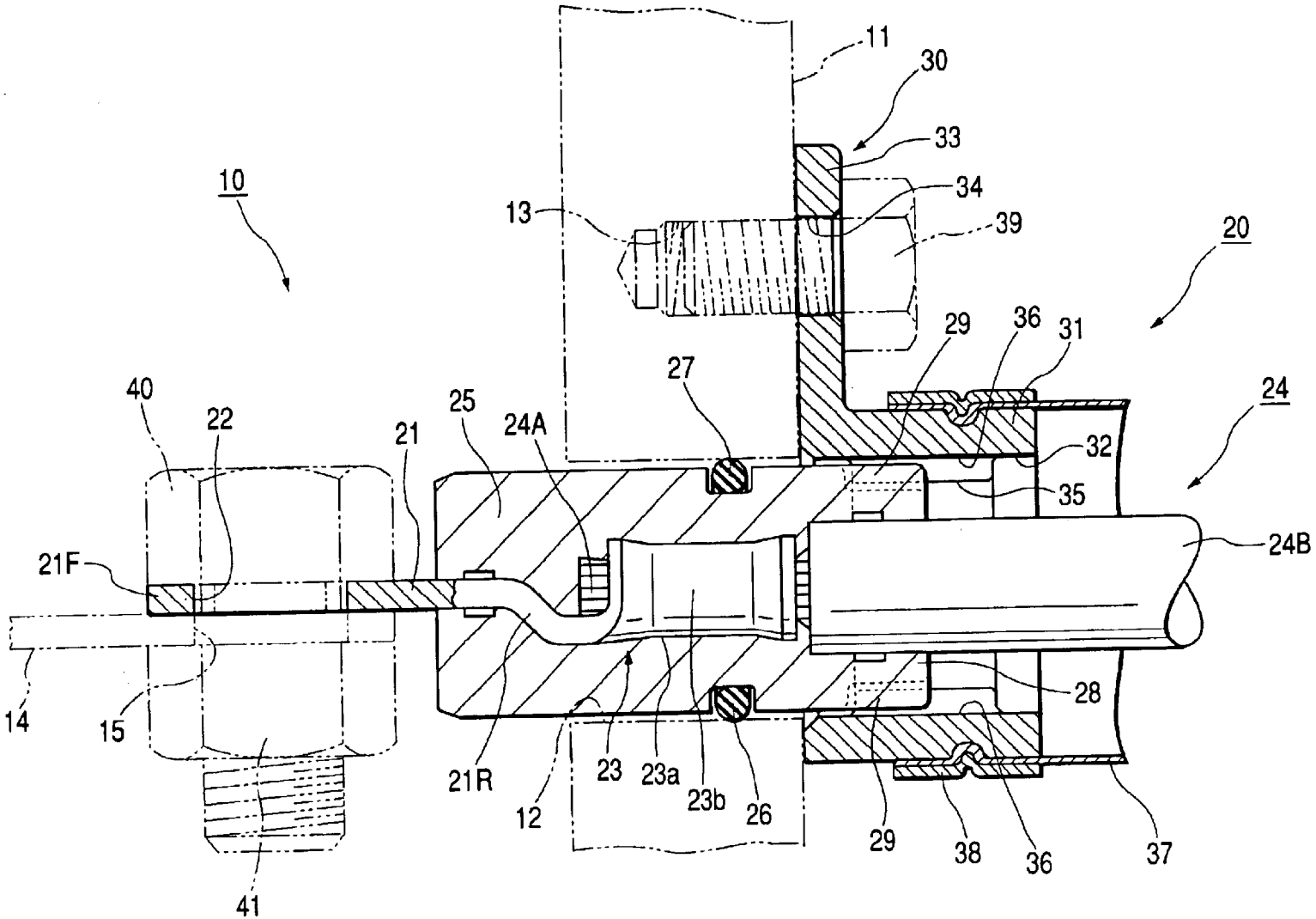
FIG. 2 is a cross sectional view showing a shielding connector when it is connected to a device.
Figure 3:
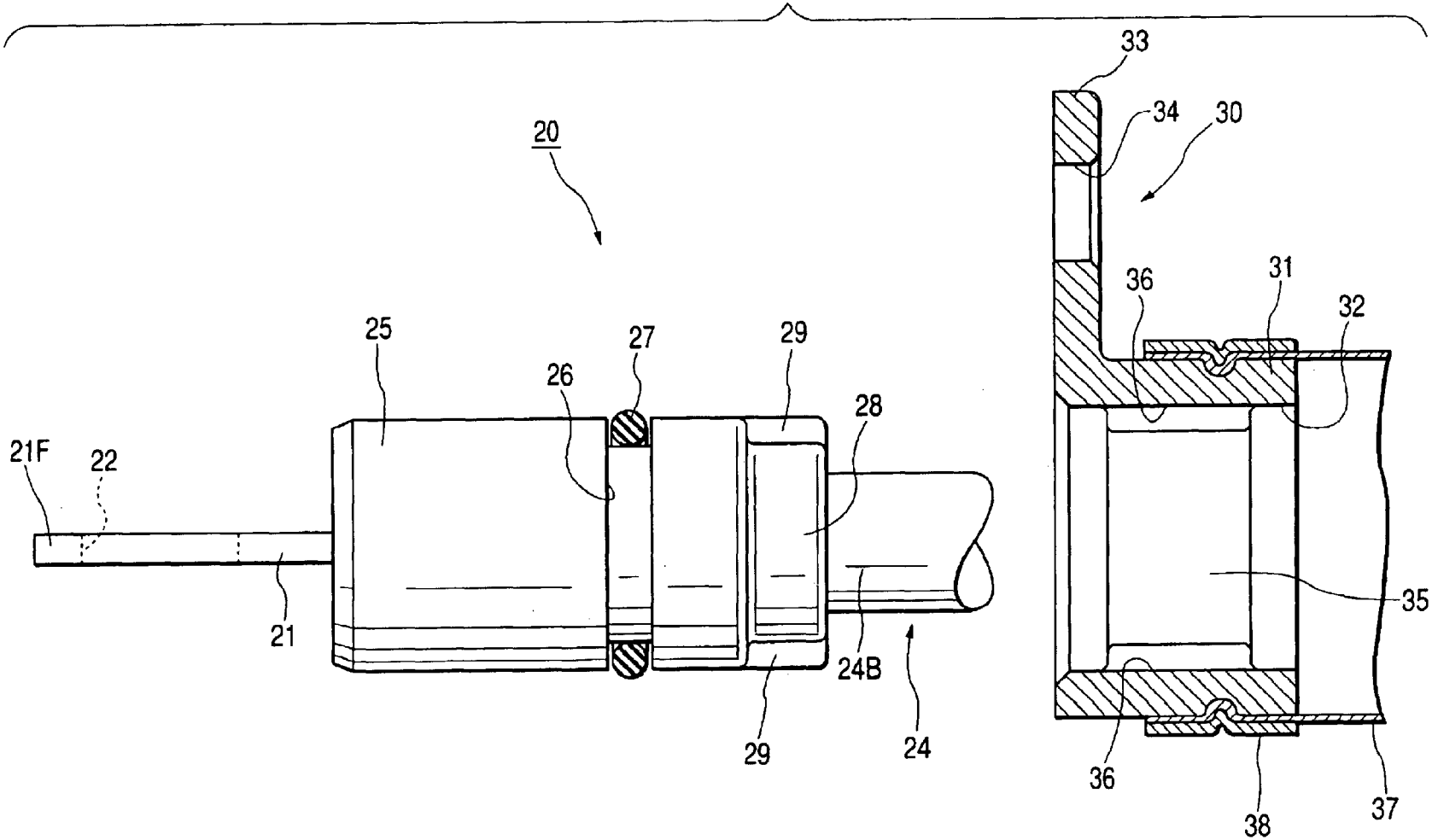
FIG. 3 is a cross sectional view showing a housing and a shielding shell, which are separated.
Figure 4:
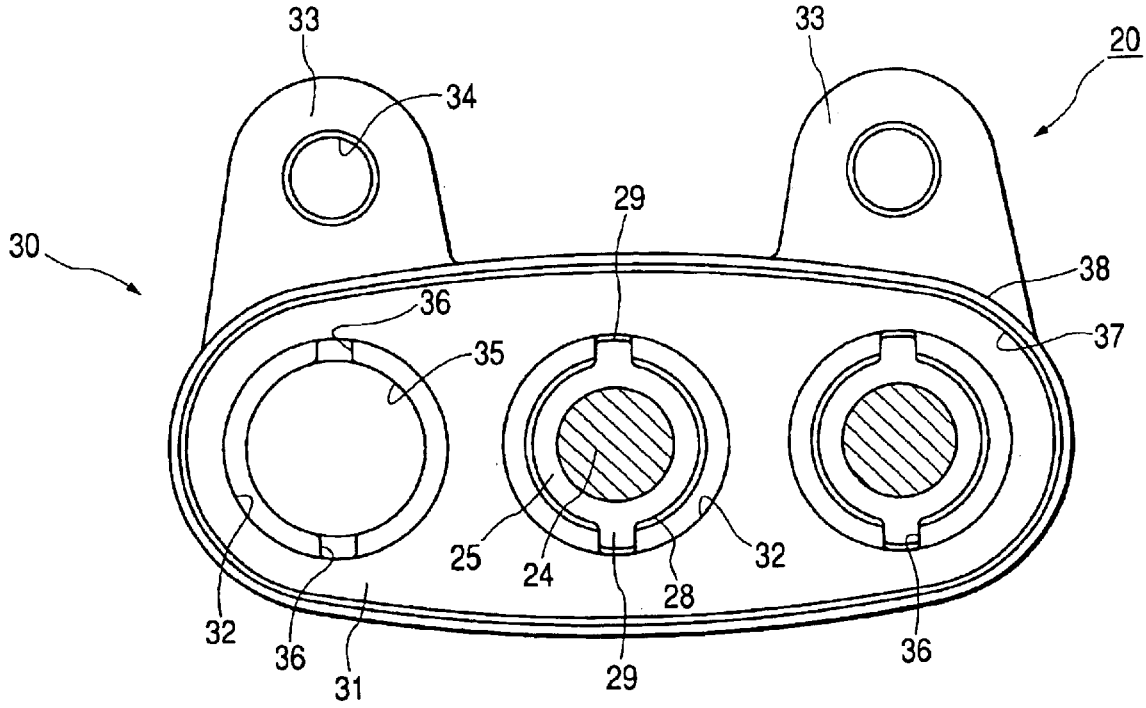
FIG. 4 is a rear view showing a structure in which the shielding shell is applied to the housing.
Figure 5:
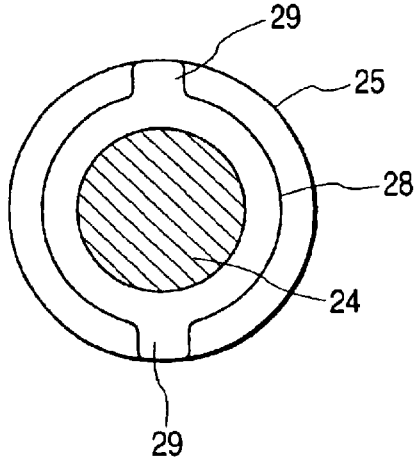
FIG. 5 is a rear view showing the housing.

An embodiment 1 of the invention will be described with reference to FIGS. 1 through 5.

A device-coupled shielding connector (a molded connector as a constituent element of the invention) 20 is mounted on an inverter unit 10 (a device forming a constituent element of the invention) of an electric motor vehicle. The inverter unit 10 is constructed such that an inverter body (not shown) is contained in a conductive shielding case 11. Three mounting holes 12, circular in shape, are formed in the side wall of the shielding case 11, while being arranged side by side (horizontally). A pair of right and left female screw holes 13, which are each closed at one end, (which are not opened at the inner surface of the shielding case 11) in an upper part of the outer surface of the side wall, which are higher than the mounting hole 12. Three device-side terminals 14 fastened to the inverter body are disposed in a state that their tip parts having connection holes 15 are directed to the mounting holes 12. The device-side terminals 14 are bus bars of high rigidity each including a thick metal plate. When those are fixed to the inverter body, the plate surfaces thereof are directed horizontally, and the connection holes 15 are vertically extended passing therethrough.

The device-coupled shielding connector 20 includes three wire-side terminals 21 (terminal fixtures forming a constituent element of the invention), three housings 25 (outer coverings forming a constituent element of the invention), and one shielding shell 30.

Each of the wire-side terminals 21 is formed with a bus bar having high rigidity as a thick metal plate, and is elongated in the front and back directions. The front end part of the wire-side terminal 21 serves as a planar device connection part 21F, and a connection hole 22 is formed in the device connection part 21F. A wire crimping part 23 (wire connection part forming a constituent element of the invention) is formed in the rear part of the wire-side terminals 21. The wire crimping part 23 is shaped like an open-barrel, viz., a pair of caulking pieces 23*b* are raised from the right and left side edges of the bottom plate 23*a*.

The wire-side terminals 21 are each fastened to the extended end part of an electric wire 24 which is extended from a motor (not shown) of a wheel and does not have a shielding function. The electric wire 24 is formed with a conductor 24A including twisted metal wires is covered with a resin, insulating cover 24B. The insulating cover 24B is removed from an extended end part of the electric wire 24, and the conductor 24A of the electric wire is exposed. The exposed conductor 24A is put on the bottom plate 23*a* of the wire crimping part 23, and the caulking pieces 23*b* are driven together to enclose the conductor 24A.

The device connection part 21F and the bottom plate 23*a* of the wire crimping part 23 are coupled to each other by a stepped coupling part 21R, so that those are vertically set off from each other. With this, the center of the device connection part 21F as viewed in the vertical and horizontal directions is aligned with the axial center of the electric wire 24.

Such three wire-side terminals 21 are individually held by the housings 25, respectively. Specifically, the wire-side terminal 21, and the wire crimping part 23 and the terminal parts of the electric wire 24 crimped to the wire crimping part 23 are set in a mold (not shown) for the housings 25, are integrated into the housings 25 within the mold by resin molding. The device connection part 21F, which includes the connection hole 22 formed therein, of each wire-side terminal 21, is protruded from the front end face of the related housing 25 in a posture that the plate surface is horizontally directed (in a posture that the connection hole 22 is vertically directed passing therethrough). The electric wire 24 is derived from the rear end surface of each housing 25. Thus, each housing 25 is externally applied to the wire crimping part 23 and the electric wire 24.

Each housing 25 is a cylindrical body of which the axis extends in the front and back directions (horizontal directions), and which is coaxial with the electric wire 24. A seal ring 27 is fit into a seal groove 26 of the outer periphery of the housing. A rear end part of the outer peripheral surface of the housing 25 is stepped down to be a small-diameter part 28. A couple of upper and lower protruded parts 29 are formed on the outer peripheral surface of the small-diameter part 28. Each protruded part 29 takes the form of a rib extending in a fitting direction in which the housing 25 is fit into the shielding shell 30.

The shielding shell 30 is made of an aluminum die-cast, and includes a body part 31 and a couple of right and left mounting parts 33. Three fitting holes 32 pass through the body part 31 in the front and back direction, while arranged side by side. Each of the right and left mounting parts 33 is formed with a plate-like member which is protruded upward from the upper edge of the front end of the body part 31, and includes a bolt hole 34 formed passing therethrough in the front and back directions. Each fitting hole is circular in shape, and the middle part of the fitting hole as viewed in the front and back direction is stepped from both ends thereof as in the same direction to form a diameter-reduced part 35, which is coaxial with the fitting hole. A pair of upper and lower recesses 36 are formed in the inner peripheral surface of the diameter-reduced part 35. Each recess 36 extends in the front and back direction, viz., in the fitting direction of the housing 25 when it is fit into the shielding shell 30. A width of the recess 36 is selected to be somewhat smaller than that of the protruded part 29 of the housing 25.

A terminal part of a flexible, cylindrical shielding member 37 for enclosing collectively the three electric wires 24 is conductively fastened to the outer peripheral surface of the shielding shell 30 by means of a caulking ring 38.

The housings 25 are fit into the fitting holes 32 of the shielding shell 30, from the front side. At this time, the protruded parts 29 of the housings 25 made of synthetic resin, while being plastically deformed, are press fit into the recesses 36 of the shielding shell 30 made of an aluminum die casting. After press fit, the three housings 25 are fastened to the shielding shell 30 by frictional resistance between the protruded parts 29 and the recesses 36 such that the housings are immovable in the front and back directions (directions in which the housings 25 are inserted and pulled out), up and down directions, and right and left directions.

As the result of fitting of the protruded parts 29 to the recesses 36, the housings 25 are positioned to the shielding shell 30 in the circumferential direction, and the plate surfaces of the wire-side terminals 21 are directed horizontally, and each wire-side terminal 21 takes a posture that all their plate surfaces are directed horizontally and the connection holes 22 are vertically directed passing therethrough. Here, a device-coupled shielding connector 20 is completed in which the three wire-side terminals 21, three housings 25 and shielding shell 30 are integrated into a one-piece construction.

To mount the thus constructed device-coupled shielding connector 20 of the embodiment on the inverter unit 10, the housings 25 are fit into the mounting hole 12, the mounting parts 33 of the wire 80 are put on the outer surface of the shielding case 11, and the bolt holes 34 of the shielding shell 30 are aligned with the female screw holes 13 of the shielding case 11, respectively. In this state, the seal ring 27 water-tightly seals up a clearance between the outer periphery of the housing 25 and the inner periphery of the mounting hole 12. The wire-side terminals 21 are placed on the upper surfaces of the device-side terminals 14, and the device-side terminals 14 are confronted with the wire-side terminals 21 in a coaxial fashion, and the connection holes 15 are confronted with the connection holes 22 in a coaxial fashion.

From this state, bolts 39 having been inserted into the bolt holes 34 of the shielding shell 30, respectively, are screwed into the female screw holes 13 of the shielding case 11, and tightened. Then, the three housings 25 are fastened to the shielding case 11, and the shielding shell 30 is conductively connected to the shielding case 11. Further, the device-side terminals 14 and the wire-side terminals 21, which are placed one on the other, are conductively connected in a manner that nuts 41 are applied to the bolts 40 having passed through the connection holes 15 and 22.

In the device-coupled shielding connector 20 of the instant embodiment, the shielding shell 30 image of an aluminum die casting, whereby a rigidity of the former is higher than that of the housings 25 made of synthetic resin. Therefore, there is no case that the shielding shell 30 is deformed to come put off the housings 25. Accordingly, the housings 25 are reliably assembled to the shielding shell 30.

When the housing 25 is press fit into the fitting hole 32, frictional resistance occurs to the relative motion between the housing 25 and the fitting hole 32. In this case, the frictional resistance occurs at only the parts where the protruded parts 29 and the recesses 36 are formed. Therefore, press-fitting resistance is smaller than that in a case where the protruded parts 29 and the recesses 36 are not formed, and the housing is press fit into the fitting hole in a state that the entire outer peripheral surface of the housing is in sliding contact with the entire inner peripheral surface of the fitting hole.

The recess 36 into which the protruded parts 29 is fit is provided as the counter part of the protruded part 29. The protruded parts 29 and the recesses 36 function to position the housings 25 and the shielding shell 30 in the circumferential direction. Specifically, the protruded parts 29 having the press-fitting function has also the positioning function. With this feature, the housings 25 and the shielding shell 30 are simplified in their configuration when comparing with the case where the positioning function part and the wrong setting function part are provided separately from the protruded part 29.

The center of the device connection part 21F is aligned with the center of the electric wire 24 and the housing 25. With this feature, the device connection part 21F passes the center of the mounting hole 12. With this, the inside diameter of the mounting hole 12 is made small, and will reduce the outside diameter of the housing 25, and the size of the molded connector.

<Embodiment 2>

Figure 6:
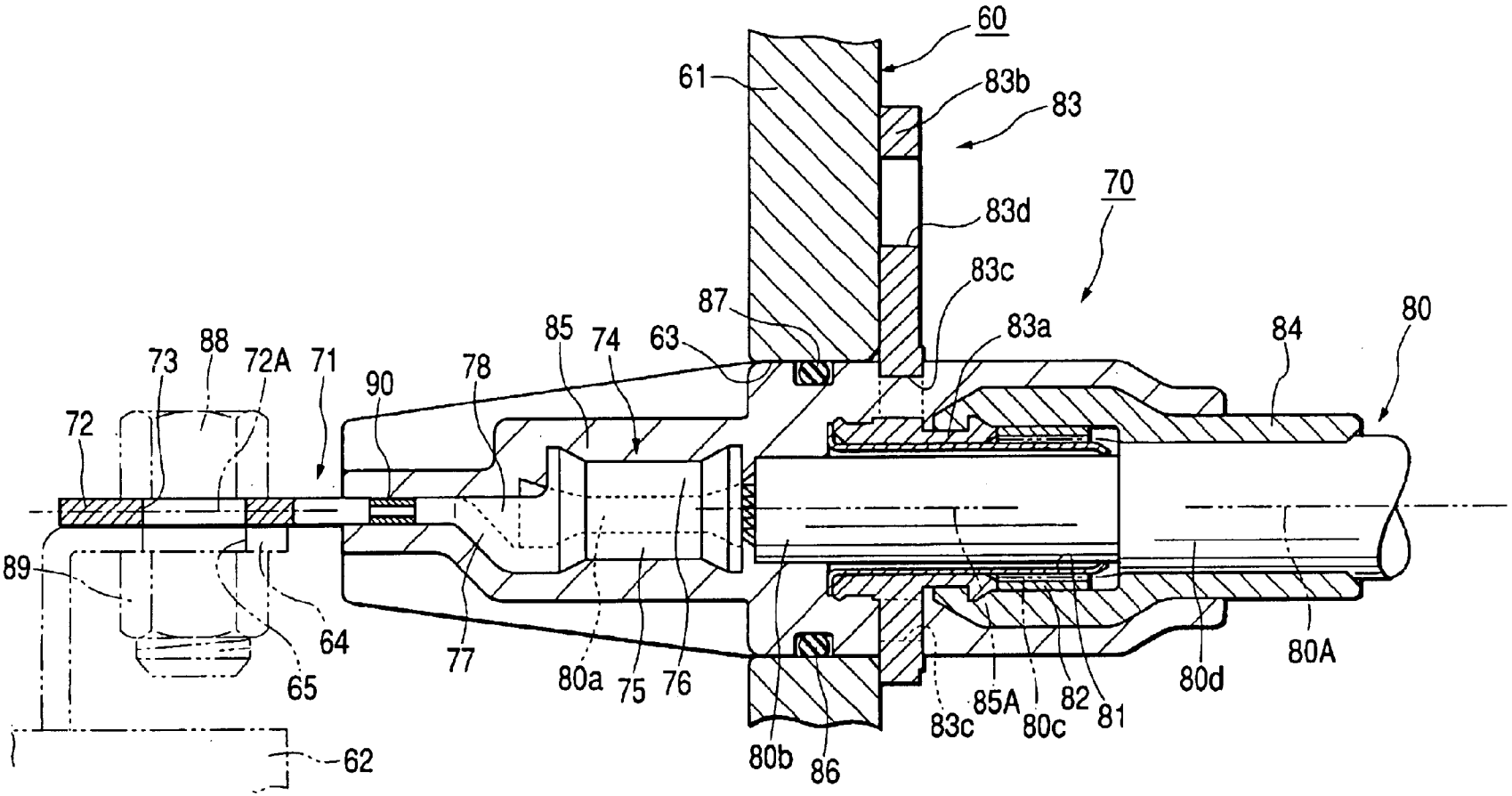
FIG. 6 is across sectional view showing a molded connector of an embodiment 2 attached to a device.
Figure 7:
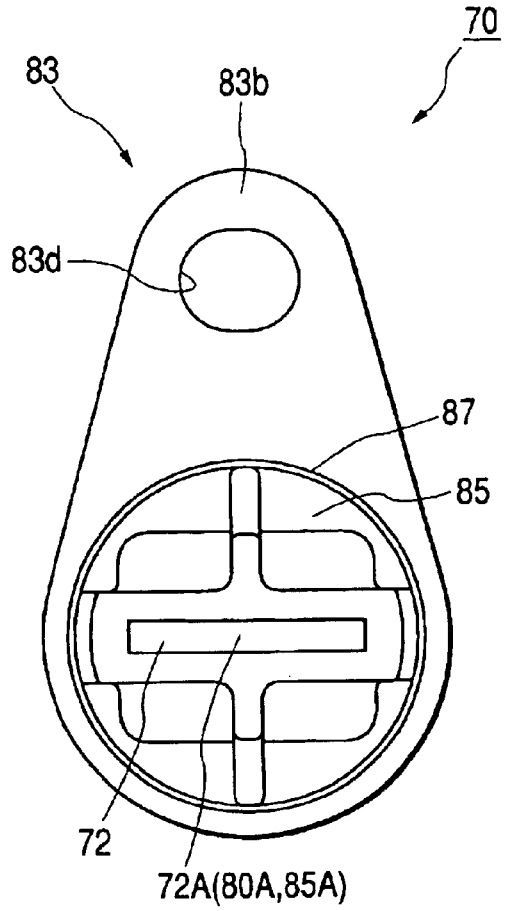
FIG. 7 is a front view showing the molded connector.
Figure 8:
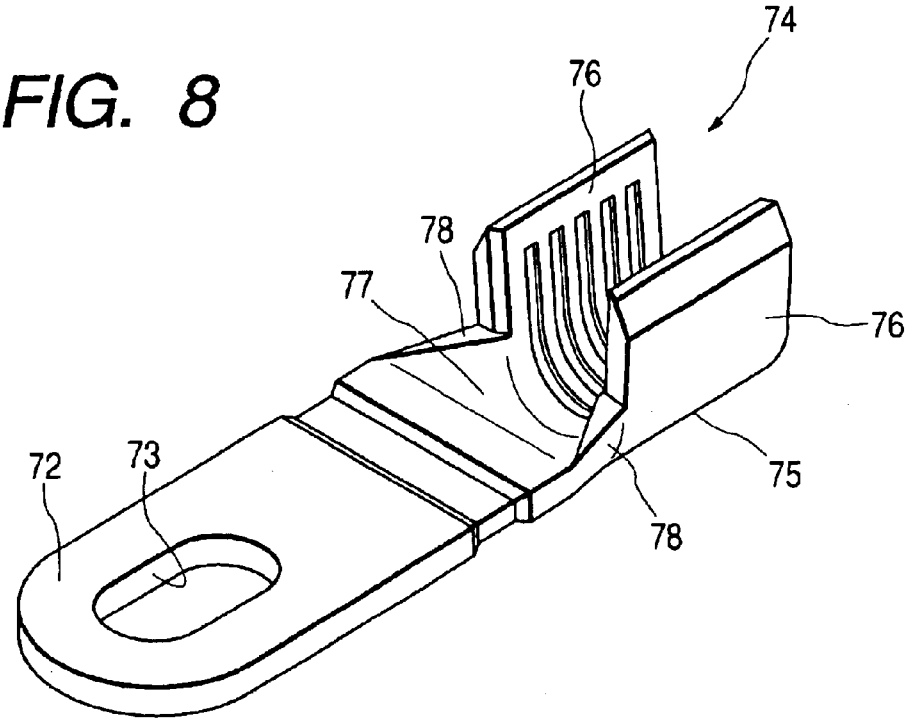
FIG. 8 is a perspective view showing a terminal fixture.
Figure 9:
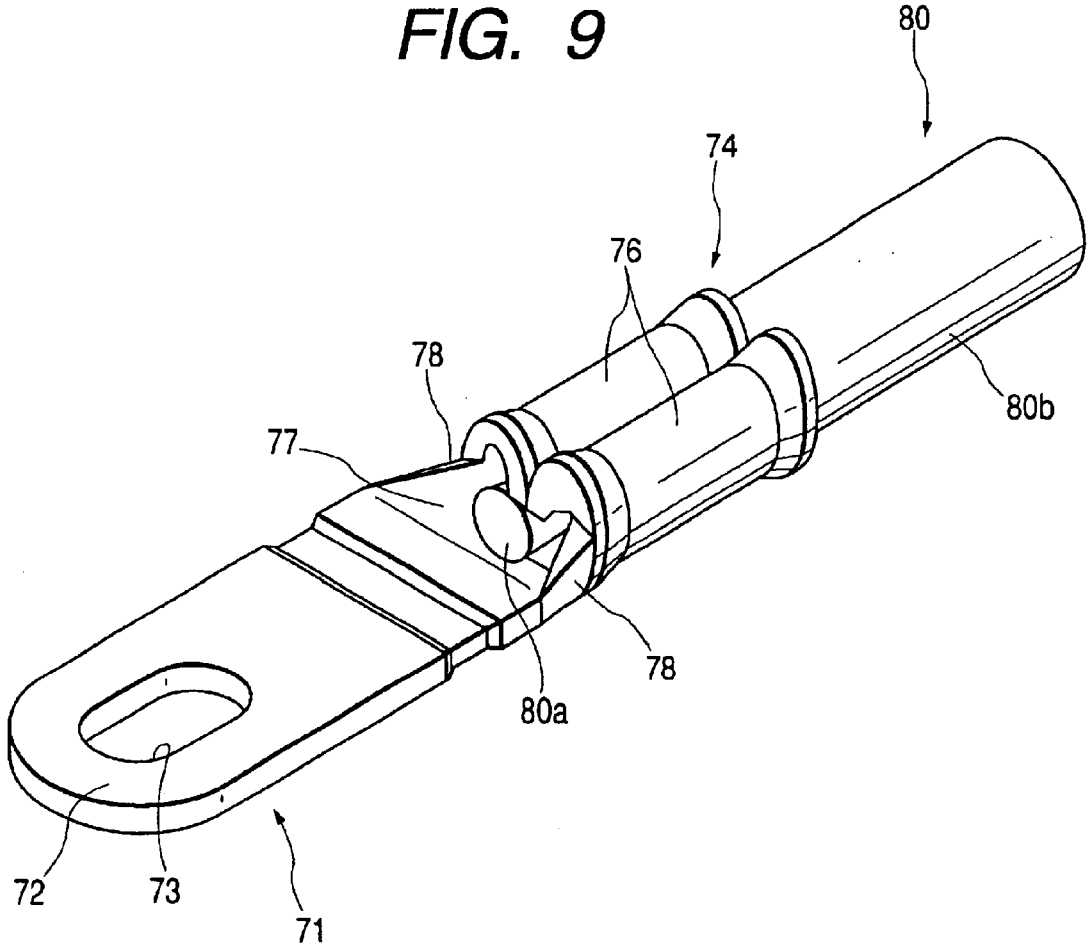
FIG. 9 is a perspective view showing a terminal fixture to which an electric wire is connected.
Figure 10:
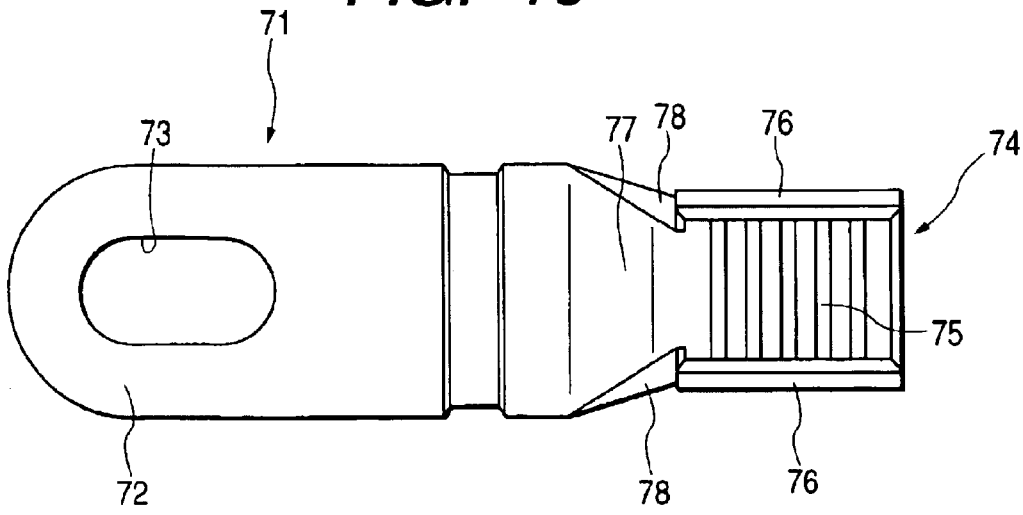
FIG. 10 is a plan view showing a terminal fixture before it is connected to an electric wire.

An embodiment 2 which is another implementation of the present invention will be described with reference to FIGS. 6 through 10.

A molded connector 70 of the instant embodiment is mounted on an inverter unit 60 (forming a constituent element of the invention) of an electric motor vehicle. The inverter unit 60 is constructed such that an inverter body 62 (a device body forming a constituent element of the invention) is contained in a conductive shielding case 61 (a case forming a constituent element of the invention). Within the shielding case 61, circular mounting holes 63 are formed while being arranged side by side (horizontally). Within the shielding case 61, a device-side terminal 64 fastened to the inverter body 62 is directed to the mounting holes. The device-side terminals 64 are bus bars of high rigidity each including a thick metal plate. When those are fixed to the inverter body 62, the plate surfaces thereof are directed horizontally, and the connection holes 65 are vertically extended passing therethrough.

A molded connector 70 includes terminal fixtures 71 and an housing 85, and is connected to an wire 80. Each terminal fixture 71 is formed with a thick metal plate having a high rigidity, and is thin and extended in the front and back directions. An end part of the terminal fixture 71 is used as a plate-like device connection part 72, and a connection hole 73 is formed in the device connection part 72. A wire connection part 74 is formed at the rear end of the terminal fixtures 71. The wire connection part 74 is shaped like an open-barrel, viz., a pair of caulking pieces 76 are raised from the right and left side edges of the bottom plate 75.

The bottom plate 75 of the wire crimping part 74 and the device connection part 72 are coupled to each other by a stepped coupling part 77, so that those are vertically set off from each other. With this, the center 72A of the device connection part 72 as viewed in the vertical and horizontal directions is aligned with the axial center 80A of the wire connection part 74 as will be described later. A couple of plate-like reinforcing parts 78 are respectively formed on the right and left side edges of the coupling part 77. Those parts 78 are continuous to the rear end of the device connection part 72 and the caulking pieces 76.

The terminal fixtures 71 are each fastened to the extended end part of an electric wire 80 which is extended from a motor (not shown) of a wheel and has a shielding function. The electric wire 80 is constructed such that a conductor 80*a* including twisted metal wires is covered with a core 80*b* made of insulating resin, a braided, cylindrical shielding layer 80*c* is applied to the outer peripheral surface of the core 80*b*. The shielding layer 80*c* is covered with a sheath 80*d* made of insulating resin. At the terminal end of the electric wire 80, the sheath 80*d* is removed and the shielding layer 80*c* is exposed, the core 80*b* is extended from the front of the shielding layer 80*c*, and the conductor 80*a* is exposed and protruded from the front end of the core 80*b*. The exposed conductor 80*a* is put on the bottom plate 75 of the wire connection part 74, and the caulking pieces 76*b* are driven together to enclose the conductor 80*a*.

Further, a conductive sleeve 81 is applied to the outer peripheral surface of the core 80*b*. An end part of the sleeve 81 is inserted to between the core 80*b* and the shielding layer 80*c*. Further, a conductive caulking tube 82 is applied to the shielding layer 80*c*. The conductive caulking tube 82 is driven to compress the shielding layer 80*c* between the caulking tube itself and the sleeve 81, so that the shielding layer 80*c* is fastened to the sleeve 81 and electrical conduction is set up between them. A conductive bracket 83 is conductively fastened to a region of the sleeve 81, which is located more forward than the conductive caulking tube 82. A tubular part 83*a* surrounding the sleeve 81 and a plate-like, oval mounting part 83*b* protruded outward from the outer peripheral surface of the tubular part 83*a* are combined into the bracket 83. A plurality of resin flowing holes 83*c* are formed in the plate-like mounting part 83*b* along the periphery of the tubular part 83*a*. A bolt hole 83*d* is formed in the upper end part of the mounting part 83*b*. A front end part of a rubber boot 84 is tightly applied to the rear end edge of the outer peripheral surface of the tubular part 83*a* (a region located more rearward than the mounting part 83*b*), and the rubber boot 84 is tightly applied to the conductive caulking tube 82 and the terminal end of the sheath 80*d* of the electric wire 80 to thereby effect the water-proof function.

The terminal fixture 71 is partially covered with the housing 85. Specifically, as for the terminal fixtures 71, the wire connection part 74 of the terminal fixture 71, the terminal end part of the electric wire 80 already crimped to the wire connection part 74, the conductive caulking tube 82, the tubular part 83*a* of the bracket 83 and a part of the bracket 83 along the outer peripheral surface of the tubular part 83*a* in the bracket 83, substantially the first half of the rubber boot 84, are set in a molding die (not shown), and within the molding die, the outer covering 85 is formed by resin molding. The thus molded outer covering 85 surrounds the above-mentioned part set in the molding die (inclusive of the wire connection part 74 and the terminal end of the electric wire 80) and in this state, those are integrated in one-piece construction.

The outer covering 85 is such that the axial center 85A of it is directed in the front and back direction (horizontal direction), and it is coaxial with the electric wire 80, and a sealing ring 87 is fit into a sealing groove 86 in the outer peripheral surface. The device connection part 72 of the terminal fixture 71 is projected from the front end face of the outer covering 85 in a state that its plate surface is directed horizontally (the connection hole 73 vertically passes therethrough). The rubber boot 84 is derived from the rear end of the outer covering 85, and the electric wire 80 is derived from the rear end of the rubber boot 84. A gap between the outer covering 85 and the electric wire 80 is sealed with the rubber boot 84 to thereby prevent liquid stuck onto the outer periphery of the electric wire 80 from entering the wire connection part 74 within the outer covering 85. The outer periphery of the rear end of the device connection part 72 is coated with adhesive 90, and the adhesive adheres to the terminal fixtures 71 and the outer covering to exhibit sealing function. In this way, the liquid stuck onto the outer periphery of the device connection part 72 is prevented from entering the wire connection part 74 within the outer covering 85.

To mount the molded connector 70 of the instant embodiment on the inverter unit 60, the device connection part 72 is directed forward and the molded connector 70 is inserted into the mounting holes 63; Its device connection part 72 is placed on the upper surface of a device-side terminal 64; the connection holes 65 and 73 are aligned with each other; and the outer covering 85 is fit into the mounting holes 63. Further, the mounting part 83*b* of the bracket 83 is brought into contact with the outer surface of the shielding case 61, ant its bolt hole 83*d* is aligned with a females screw part (not shown) of the shielding case 61.

When from this state, a bolt (not shown) is passed through the bolt hole 83*d* of the bracket 83 and screwed into the female screw part of the shielding case 61, the molded connector and its bracket 83 are fastened to the shielding case 61, and the shielding layer 80*c* of the electric wire 80 is conductively connected to the shielding case 61, through the sleeve 81 and the bracket 83. In this state, the outer covering 85 is coaxial with the mounting holes 63, and the sealing ring 87 seals a clearance between the outer covering 85 and the mounting hole 63. Further, the device connection part 72 and the device-side terminal 64, which are placed one on the other, are conductively coupled with each other when the bolt 88 having passed through the connection holes 65 and 73 is screwed into the nut 89 and fastened.

As described above, in the instant embodiment, the center 72A of the device connection part 72 is aligned with the axial center 80A of the electric wire 80 and the axial center 85A of the outer covering 85. Accordingly, to mount the molded connector to the inverter unit 60, the device connection part 72 is passed through the center of the mounting holes 63, and then the outer covering 85 may be fit into the mounting hole 63 without vertically moving the molded connector 70. Since the device connection part 72 passes through the center of the mounting holes 63, the inside diameter of the mounting holes 63 is made small, and will reduce the outside diameter of the outer covering 85, and the size of the molded connector.

To align the center 72A of the device connection part 72 with the axial center 80A of the electric wire 80, the bottom plate 75 of the wire connection part 74 and the device connection part 72 are coupled to each other by the coupling part 77 as a stepped plate. In the embodiment, reinforcing parts 78 are provided on the right and left side edges of the coupling part 77, which the reinforcing parts 78 are continuous to the front ends of the caulking pieces 76 and the rear end of the device connection part 72. With provision of the reinforcing parts, the coupling part 77 is prevented from being deformed, and hence, the device connection part 72 is reliably held in a state that it is coaxial with the electric wire 80.

<Other Embodiments>

It should be understood that the present invention is not limited to the embodiments as described above while referring to the accompanying drawings, but may involve the following embodiments and be variously modified, altered and changed within the true scope of the invention.

1) In the embodiments, the device connection part is shaped like a plate and connected by the bolt. In an alternative, a combination of a circular pin and a hole is used, and the device-coupled shielding connector is connected to the device body in a male/female coupling manner.

2) The embodiment 2 may be modified such that the bracket is provided separately from the device-coupled shielding connector, and the former is assembled to the latter.

3) In addition to crimping means, press contacting means may be used for coupling the electric wire to the wire connection part.

4) In the embodiments, the device to which the device-coupled shielding connector is to be connected is an inverter unit of an electric motor vehicle. It is evident that the invention is applicable to any other suitable device than the inverter unit.

5) In the embodiments mentioned above, the invention is applied to the device-coupled shielding connector having a water-proof function, but it may be applied to the connector not having such a function.

6) In the embodiment 1 mentioned above, the protruded part is formed on the outer periphery of the housing, and the recess part is formed in the inner periphery of the shielding shell. In an alternative, the recess part is formed in the housing, and the protruded part is formed on the shielding shell. In another alternative, the protruded part and the recess part are provided on and in the housing, and those are also provided on and in the shielding shell.

7) In the embodiment 1, the recess part is fit to the protruded part. In an alternative, the recess part is not provided, and the protruded part is brought into contact with a flat part of the device as its counter part.

8) In the embodiment 1, the protruded part as the press fitting functional part is designed to have both the positioning function and the wrong setting preventing function. However, if required, means having the positioning function or means having the wrong setting preventing function may be provided separately from the protruded part.

9) In the embodiments mentioned above, the shielding shell is made of an aluminum die casting. If required, it may be formed using a conductive resin material by die molding. Forging process may be used for forming the shielding shell.

10) In the embodiment mentioned above, one wire-side terminals is held by one housing. If required, a plurality of wire-side terminals may be held by one housing.

What is claimed is:

1. A molded electrical connector to be mounted on a device in which a device body is accommodated in a case having a circular mounting hole, said electrical connector comprising:

a terminal fixture having a device connection portion and a wire connection portion connected to an electric wire, said device connection portion having a connection hole, and a circular outer covering of a predetermined diameter which is coaxial with said electric wire and is applied to said wire connection portion and a terminal part of said electric wire, said outer covering being fit into said mounting hole, and said device connection portion being connected to said device body, wherein the longitudinal axis of said device connection portion is aligned with the axial center of said electric wire and said device connection portion has a diameter not more than the diameter of the outer covering.

2. The electrical connector according to claim 1, wherein said wire connection portion has a plate portion, the plate portion having an open barrel portion with a pair of oppositely opposed caulking pieces that extend from opposing side edges of said plate thereof;

said pair of caulking pieces are deformable so as to retain said electric wire.

3. The electrical connector according to claim 2, wherein reinforcing parts are respectively formed on opposing edges of said coupling part, said reinforcing parts being continuous to front ends of said pair of caulking pieces and to a rear end of said device connection portion.

4. The electrical connector according to claim 2, wherein said plate of said wire connection portion and said device connection portion are coupled to each other by a stepped coupling portion so as to be vertically set off from each other.

5. The electrical connector according to claim 1, wherein a seal ring is provided on an outer periphery of said covering.

* * * * *